US005129583A

United States Patent [19]

Bailey et al.

[11] Patent Number: 5,129,583

[45] Date of Patent: Jul. 14, 1992

[54] LOW PRESSURE LOSS/REDUCED DEPOSITION ATOMIZER

[75] Inventors: Ralph T. Bailey, Uniontown; Michael J. Holmes, Alliance, both of Ohio

[73] Assignee: The Babcock & Wilcox Company, New Orleans, La.

[21] Appl. No.: 672,820

[22] Filed: Mar. 21, 1991

[51] Int. Cl.[5] ..... B05B 7/04

[52] U.S. Cl. ..... 239/427; 239/430; 239/433

[58] Field of Search ..... 239/427, 429, 430, 433, 239/589, 590

[56] References Cited

U.S. PATENT DOCUMENTS

| | | | |
|---|---|---|---|
| 2,175,160 | 10/1939 | Zobel et al. | 239/589 |
| 3,419,220 | 12/1968 | Goodwin et al. | 239/591 |
| 3,809,524 | 5/1974 | Bruhlet et al. | 239/433 |
| 3,920,187 | 11/1975 | Willis | 239/427 |
| 4,160,526 | 7/1979 | Flanagan | 239/427 |
| 4,300,723 | 11/1981 | Prasthofer | 239/589 |
| 4,478,368 | 10/1984 | Yie | 239/430 |
| 4,625,916 | 12/1986 | Nieuwkamp et al. | 239/431 |
| 4,690,333 | 9/1987 | Johansson | 239/433 |
| 4,819,878 | 4/1989 | Bailey et al. | 239/427 |
| 4,915,302 | 4/1990 | Kraus et al. | 239/430 |
| 5,035,090 | 7/1991 | Szücs | 239/433 |

FOREIGN PATENT DOCUMENTS

| | | | |
|---|---|---|---|
| 1140833 | 2/1985 | U.S.S.R. | 239/429 |

OTHER PUBLICATIONS

J. M. Beer & N. H. Chigier, *Combustion Aerodynamics*, Robert E. Krieger Publishing Co., Malabar, Fla., 1983 (pp. 124–127 & 187).

G. M. Blythe, et al., *Evaluation of a 2.5-MW Spray Dryer/Fabric Filter $SO_2$ Removal System*, EPRI Report #CS-3953, May, 1985, pp. 9–10.

M. Babu et al., *Duct Injection Technologies for $SO_2$* Control, First Combined FGD and Dry $SO_2$ Control Symposium, Paper No. 10-2, Oct. 1988 (p. 73).

*Primary Examiner*—Andres Kashnikow
*Assistant Examiner*—Lesley D. Morris
*Attorney, Agent, or Firm*—Vytas R. Matas; Robert J. Edwards; Daniel S. Kalka

[57] ABSTRACT

An atomizer for discharging a jet of one fluid in another fluid, comprises a nozzle head having at least one nozzle hole therein for discharging the jet. The nozzle hole has an inwardly tapering inlet end and an outwardly tapering outlet end for reducing recirculation and wetting at the exit of the hole. The outlet end tapers at an angle of no greater than 14° and the inlet end is advantageously curved at a radius which is from 2 to 10 times the diameter of the inlet end. The diameter inlet end should also be from 1 to 5 times the length of the hole.

5 Claims, 1 Drawing Sheet

LOW PRESSURE LOSS/REDUCED DEPOSITION ATOMIZER

FIELD AND BACKGROUND OF THE INVENTION

The present invention relates in general to dual fluid atomizers, and in particular to internal mix atomizers having new and improved nozzle designs.

Dual fluid atomization is a method which uses the momentum supplied by a compressible fluid (usually air or steam) to break a liquid up into very fine droplets. For the case described here, this is done by internally mixing the liquid and compressible fluid and spraying the mixture into the surrounding gas through small orifices. These orifices are typically sharp edged at both their inlet and their outlet.

Often, processes which utilize dual fluid atomizers involve spraying into a dusty environment and have problems with deposition around the outlet of the atomizer orifices. Among current methods of dealing with these problems are physically cleaning the atomizers in situ, shutting down the process to physically clean the atomizers, or using vent air (i.e. a clean air flow around the immediate vicinity of the atomizers) to reduce the deposition of dust on the atomizers.

A few nozzle designs are known which incorporate a single discharge hole with a conical outlet. (See, for example, U.S. Pat. No. 4,625,916 and J.M. Beer & N.H. Chigier, *Combustion Aerodynamics,* Robert E. Krieger Publishing Company, Malabar, Fl., 1983 (pp. 124–127 & p. 187). There is no suggestion to shape the nozzle to maintain spray quality (i.e. drop sizes) at constant consumption and pressure of a compressible fluid or for the purpose of controlling atomizer deposition, in these references, however.

U.S. Pat. No. 3,419,220 depicts a tapered nozzle on the entrance side to make the nozzle more wear-resistant. U.S. Pat. No. 4,625,916 provides a nozzle having a bore which diverges on the exit side. There is nothing in either of these two references which suggests a combination of these features or suggests a resulting reduction in deposition or a decrease in irrecoverable pressure losses. Other references of interest are G. M. Blythe, et al, *Evaluation of a* 2.5-MW Spray Dryer/Fabric Filter $SO_2$ *Removal System,* EPRI Report #CS-3953, May, 1985 (pp. 9–10); and M. Babu, et al, *Duct Injection Technologies for $SO_2$Control,* First Combined FGD and Dry $SO_2$ Control Symposium, Paper No. 10-2, Oct., 1988 (p. 73).

SUMMARY OF THE INVENTION

The present invention involves alterinq the design of existing dual fluid atomizers to reduce deposition on the atomizer and to reduce unrecoverable pressure losses while maintaining spray quality. The exit holes are made using tapered expansions rather than the sharp edged exits that are currently used. Either tapered contractions or bell mouths can be used on the inlets to these holes to further reduce the unrecoverable pressure losses. An outlet taper on the exit hole is designed to reduce wetting of the atomizer tip and thereby minimize atomizer deposition. In addition, this taper reduces unrecoverable pressure losses associated with straight drilled holes.

According to the invention the cone angle of the tapered discharge holes should be less than 14°. Flow through larger angle expansions can cause recirculation in the hole and reduce the desired benefit.

For the assignee of the present invention, a problem is most frequently seen in environmental applications where a liquid or slurry is sprayed into dust laden flue gas. In these applications, it is not uncommon to find large deposits on the atomizers which have to be removed. As deposits are formed, the atomizer performance suffers. Larger droplets are made and the rate of atomizer wetting increases because of the disturbance to the system caused by these deposits. Therefore, a reduction in atomizer deposition can be expected to allow the process to run more reliably as well as at lower operating costs.

The feasibility of the present invention for reducing atomizer deposition has been established by actual test results using a water and air mixture. The nozzles were shaped to keep the flow of fluid more streamlined throughout and reduce turbulence of the jets at the nozzle exits. The existence of this turbulence causes wetting of the atomizer which promotes the growth of deposits. Reduced wetting of the atomizer tip was seen with the shaped holes which should mean a reduction in deposit formation. Any reduction in deposition should lower vent air requirements and/or atomizer cleaning requirements.

When dual fluid atomizers are operated to obtain small droplet sizes, the limiting factors are typically air pressure and air consumption. These factors are limited both in terms of availability and the expense associated with them. One objective of this invention is to maintain the spray quality for a given atomizer at given flowrates with a reduction in air pressure/flow requirements. Energy savings are realized because there is less unrecoverable pressure loss with the invention than with straight hole nozzles. Although the invention is illustrated for a single dual fluid atomizer design it can be used in atomizers with multiple nozzles and in any other dual fluid design.

There is also the potential for a reduction in atomizer wear with the shaped holes of the invention. This is based on the idea that the flows should be more streamlined and less frictional forces would exist in the atomizer internals.

As a preferred embodiment to the invention, the air holes are also shaped. The inlets to the air passages are tapered or rounded inwardly in a direction toward the outlet end, and the outlets are tapered inwardly in the direction of the inlet. The object of the shaped air holes is to further reduce irrecoverable pressure losses. The shaped air holes do not contribute to the reduction in atomizer deposition or wear.

Accordingly an object of the present invention is to provide an atomizer for discharging a jet of a first fluid in a second fluid, comprising: a nozzle head defining a space for receiving a mixture containing the first and second fluids; a nozzle hole through said nozzle head for discharging the jet; first fluid supply means connected to said nozzle head for supplying the first fluid to the nozzle head; second fluid supply means connected to the nozzle head for supplying the second fluid to the nozzle head; and the nozzle hole having an inlet end in communication with the space and an outlet end for discharging the jet from the space, the inlet end being tapered or rounded inwardly in a direction toward the outlet end, and the outlet end being tapered inwardly in the direction of the inlet end, the taper of the outlet end being at an angle which is selected so that a flow of the jet through the hole is streamlined to reduce recirculation at the exit of the hole and reduce wetting of the atomizer tip.

A further object of the present invention is to provide an atomizer wherein the angle of the cone at the outlet end is less than 14°.

A still further object of the present invention is to provide an atomizer which is simple in design while avoiding turbulence which leads to wetting, which has been recognized by the inventors of the present invention as a source for the building of undesirable deposits, and as an area of irrecoverable pressure loss. There is also theoretical evidence that the shaped holes could allow outlet velocities above sonic. Therefore, an additional object of the invention would be to further reduce droplet sizes by increasing the jet velocity without increasing flow and pressure requirements.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENTS

Figure 1:
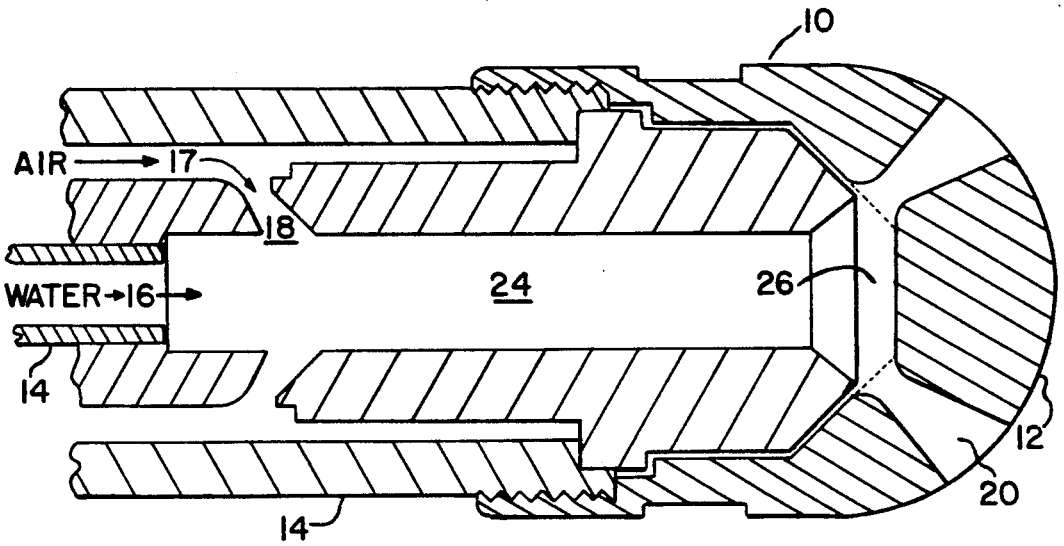
FIG. 1 is a sectional view, partially in elevation of an atomizer in accordance with the present invention.

Referring to the drawings in particular, the invention embodied in FIG. 1 comprises an atomizer generally designated 10 having a hollow nozzle head 12 which defines a vestibule 26 for receiving a mixture of a first fluid (such as water or other liquid or slurry) in a second fluid (such as air or other gas). The second fluid is generally expandable to help disperse the first fluid and help discharge a jet of finely atomized fluid through a nozzle hole 20 extending in the nozzle head 12.

The first fluid such as water, is supplied through first fluid supply means in the form of a liquid passage 16 to a mixing chamber 24 which is followed by a vestibule 26. The expandable second fluid, in this case air, is supplied through the conical or rounded inlet 17 of an air passage 18. Supply lines (not shown) for the water and air are connected to supply conduits 14 which also mechanically support the nozzle head 12.

The shaped holes can either be provided by shaping the holes in the nozzle head as discussed above, or by using shaped inserts.

Figure 2:
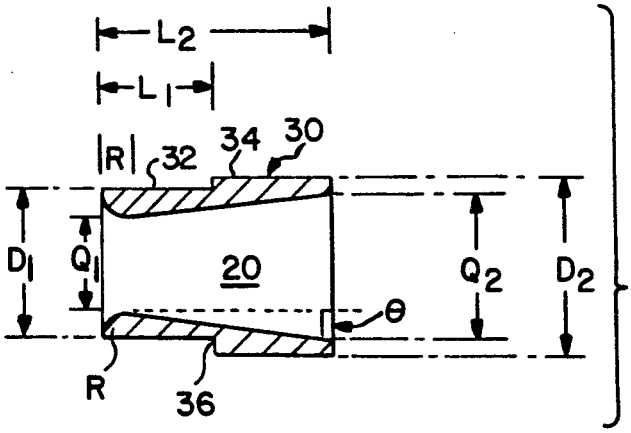
FIG. 2 is a nozzle insert, on an enlarged scale, which can be used for the atomizer FIG. 1.

The insert is best shown in FIG. 2, a nozzle insert 30 which can be fixed to the nozzle head, contains the nozzle hole 20. The nozzle hole 20 has an inlet end with a diameter $Q_1$ and an outlet end with a diameter $Q_2$. The inlet end tapers, on a conical or curved surface, inwardly toward the outlet end. Conversely the outlet end tapers inwardly on a conical or curved surface toward the inlet end. In a preferred embodiment of the invention, the tapered extent of the outlet end is at a cone angle of no more than $14^0$. The inlet end tapers on a radius R. To provide a sufficiently smooth and streamlined entry condition for the jet mixture, the ratio between the inlet end diameter $Q_1$ and the radius R is preferable from 2 to 10.

To allow flow within the hole 20 time to become streamlined, the nozzle insert 30 should also be sufficiently long. It is advantageous to provide the ratio between the total nozzle length $L_2$ and the nozzle inlet diameter $Q_1$, to be within the ratio 1 to 5.

The taper angle Θ which is one-half of the cone angle, is advantageously from 1½° to 7°.

For installation, nozzle insert 30 has a small diameter inlet end portion 32 having outer diameter $D_1$, a step 36 near the middle of the nozzle, and a large diameter outlet end 34 having a outer diameter $D_2$.

This reduces the material required for constructing the insert which is often a hardened material that is more expensive than the material of the nozzle head and other portions of the atomizer.

Actual experiments which verify the feasibility of the present invention were conducted with an insert having the following specific dimensions:

$L_1=0.125''$
$L_2=0.250''$
$D_1=0.1540''$
$D_2=0.1870''$
$Q_1=0.1065''$
$Q_2=0.1541''$
$R=0.0235''$
$\Theta=6°$ While a specific embodiment of the invention has been shown and described in detail to illustrate the application of the principles of the invention, it will be understood that the invention may be embodied otherwise without departing from such principles.

What is claimed is:

1. A dual fluid low pressure loss and reduced deposition atomizer for discharging a jet of a first compressible fluid and a second fluid, comprising:

a nozzle head defining a space for receiving a mixture containing the first and second fluids;

a nozzle hole through said nozzle head for discharging the jets;

first fluid supply means connected to said nozzle head for supplying a first fluid to the nozzle head;

second fluid supply means connected to the nozzle head for supplying a second fluid to the nozzle head;

the nozzle hole having an inlet end adjacent the space, an outlet end for discharging the jet from the space, and a minimum diameter therebetween, the inlet end being tapered inwardly at a curved radius in a direction toward the outlet end, said inlet end being defined by a ratio between the minimum diameter and the curved radius thereof from about 2 to about 10, and the outlet end being tapered conically and inwardly in a direction toward the inlet end, the taper of the outlet end being at an angle no greater than about 7° to a central axis of the hole to provide a cone angle of no greater than about 14° which is selected so that a flow of the jet through the hole is streamlined to reduce wetting of the atomizer tip, wear of the hole by the jet, and irrecoverable pressure losses; and an insert connected to the nozzle head for containing the nozzle hole, said insert having a small diameter inlet portion defining the inlet and a large diameter outlet portion defining the outlet end.

2. An atomizer according to claim 1 wherein the cone angle of the outlet end is from 3° to 14°.

3. An atomizer according to claim 1 wherein a ratio between the length of the nozzle hole and the minimum diameter of the nozzle hole is from about 1 to 5.

4. A nozzle insert for a dual fluid atomizer which reduces deposition on the atomizer, comprising an insert member having a hole therethrough with an inlet end for receiving a mixture of one fluid in another fluid, an outlet end for discharging a jet of the mixture and a minimum diameter therebetween, the inlet end being tapered inwardly at a curved radius toward the outlet end, the inlet end being defined by a ratio between the minimum diameter end and the curved radius of from about 2 to about 10 and the outlet end being tapered inwardly toward the inlet end, the hole having a central axis, the outlet end having a taper angle of no greater than 7° to the axis.

5. A nozzle insert according to claim 4 wherein the outlet end tapers at a cone angle of from about 3° to 14°.

* * * * *